US011548674B2

(12) United States Patent
Vellutato, Jr.

(10) Patent No.: US 11,548,674 B2
(45) Date of Patent: Jan. 10, 2023

(54) PACKAGED, STERILIZED PRODUCT FOR INTRODUCTION INTO CONTROLLED ENVIRONMENT

(71) Applicant: Veltek Associates, Inc., Malvern, PA (US)

(72) Inventor: Arthur Vellutato, Jr., Malvern, PA (US)

(73) Assignee: Veltek Associates, Inc., Malvern, PA (US)

( * ) Notice: Subject to any disclaimer, the term of this patent is extended or adjusted under 35 U.S.C. 154(b) by 1 day.

(21) Appl. No.: 16/991,519

(22) Filed: Aug. 12, 2020

(65) Prior Publication Data

US 2020/0407091 A1 Dec. 31, 2020

Related U.S. Application Data

(63) Continuation of application No. 16/034,718, filed on Jul. 13, 2018, now Pat. No. 10,766,653, which is a continuation of application No. 14/068,474, filed on Oct. 31, 2013, now Pat. No. 10,035,615.

(60) Provisional application No. 61/889,583, filed on Oct. 11, 2013.

(51) Int. Cl.

| | |
|---|---|
| ***B65B 55/00*** | (2006.01) |
| ***B65B 55/16*** | (2006.01) |
| ***B65B 69/00*** | (2006.01) |
| ***B65B 11/58*** | (2006.01) |
| *B65B 5/10* | (2006.01) |

(52) U.S. Cl.

CPC ..... *B65B 55/16* (2013.01); *B65B 11/58* (2013.01); *B65B 69/00* (2013.01); *B65B 5/10* (2013.01); *B65B 2220/20* (2013.01)

(58) Field of Classification Search

CPC ..... A61L 2202/18; B65B 25/14; B65B 69/00
USPC ..... 53/425, 426, 428
See application file for complete search history.

(56) References Cited

U.S. PATENT DOCUMENTS

| | | | |
|---|---|---|---|
| 3,754,368 | A | 8/1973 | Moore et al. |
| 4,700,838 | A | 10/1987 | Falciani et al. |
| 5,281,027 | A | 1/1994 | Thrall |
| 5,863,496 | A | 1/1999 | McElhany |

(Continued)

FOREIGN PATENT DOCUMENTS

| | | | | |
|---|---|---|---|---|
| JP | 2013073950 A | * | 4/2013 | ..... H01L 21/26513 |
| JP | 2013073950 A | | 8/2016 | |

OTHER PUBLICATIONS

English translation; Abstract; Japan Publication No. JP2013073950; Publication Date: Aug. 18, 2016; 1 page.

(Continued)

*Primary Examiner* — Eyamindae C Jallow
(74) *Attorney, Agent, or Firm* — Blank Rome LLP

(57) ABSTRACT

The invention provides a method of packaging a sterilized product. The method includes the steps of providing a product and sterilizing the product. The sterilized product is enclosed in a first layer, which is substantially hermetically sealed to form a first sealed enclosure. The first sealed enclosure is enclosed in a second layer, which is substantially hermetically sealed to form a second sealed enclosure. The second sealed enclosure is enclosed in a third layer, which is substantially hermetically sealed to form a third sealed enclosure. The third sealed enclosure is enclosed in a fourth layer, which is substantially hermetically sealed to form a packaged product.

26 Claims, 4 Drawing Sheets

(56) References Cited

U.S. PATENT DOCUMENTS

| | | | | |
|---|---|---|---|---|
| 5,923,942 | A | 7/1999 | Nuggehalli et al. | |
| 6,123,900 | A | 9/2000 | Vellutato | |
| 6,333,006 | B1 | 12/2001 | Vellutato | |
| 6,607,698 | B1 | 8/2003 | Spears et al. | |
| 7,963,396 | B2 * | 6/2011 | Vanderbush | B65D 81/203 206/524.8 |
| 2002/0175105 | A1 * | 11/2002 | Suzuura | B32B 27/08 206/487 |
| 2003/0206825 | A1 * | 11/2003 | Vellutato | A61L 2/0035 422/40 |
| 2004/0016211 | A1 | 1/2004 | Osborne et al. | |
| 2006/0259195 | A1 | 11/2006 | Eliuk et al. | |
| 2007/0084145 | A1 | 4/2007 | Scheerer | |
| 2008/0199353 | A1 | 8/2008 | Mlodzinski et al. | |
| 2011/0212327 | A1 | 9/2011 | Zein et al. | |
| 2012/0096817 | A1 * | 4/2012 | Dickerson | B26F 3/00 53/381.1 |
| 2012/0205272 | A1 * | 8/2012 | Heilman | B65D 75/38 206/391 |
| 2013/0206616 | A1 | 8/2013 | Mien et al. | |
| 2013/0270128 | A1 | 10/2013 | Samii et al. | |
| 2013/0284028 | A1 * | 10/2013 | Fan | F24F 3/163 96/416 |
| 2014/0288511 | A1 * | 9/2014 | Tan-Malecki | B65B 55/08 604/244 |
| 2014/0290162 | A1 * | 10/2014 | Tanimoto | F24F 3/167 52/234 |
| 2015/0231628 | A1 * | 8/2015 | Nozaki | B01L 3/508 53/473 |

OTHER PUBLICATIONS

International Preliminary Report on Patentability for PCT/US2014/059896 dated Apr. 12, 2016; 7 pages.

* cited by examiner

PACKAGED, STERILIZED PRODUCT FOR INTRODUCTION INTO CONTROLLED ENVIRONMENT

RELATED APPLICATION

This application is a continuation of U.S. application Ser. No. 16/034,718, filed Jul. 13, 2020, which is a continuation of U.S. application Ser. No. 14/068,474, filed Oct. 31, 2013, now U.S. Pat. No. 10,035,615, which claims priority under 35 U.S.C. § 119 to U.S. Provisional Application Ser. No. 61/889,853, filed Oct. 11, 2013, the disclosures of which are incorporated herein by reference in their entirety.

FIELD OF THE INVENTION

The invention relates to a method of packaging sterilized products for use in a sterile environment. In particular, the invention provides a method by which sterilized products, namely paper products, are enclosed in four successively sealed layers such that they may be introduced into a cleanroom without contaminating the environment with particulates and microorganisms.

BACKGROUND OF THE INVENTION

Sterile "cleanroom" environments demand that any person or item entering the room be free of a certain level of contaminants. Sterilized environments are most commonly designed for use in manufacturing facilities and medical research and treatment facilities in the pharmaceutical, biotechnology, and healthcare industries, to name a few. Sterile cleanroom environments may be classified under a variety of classification schemes, including the International Organization of Standardization ("ISO") Cleanroom Standards, whereby the highest level of sterilization is an ISO 1 cleanroom, and normal ambient air (no sterilization) is classified as ISO 9.

A variety of products are required to enter cleanroom environments, including paper and paper products used to document manufacturing and testing records within the controlled areas. Such paper products include, but are not limited to, forms, logbooks, tags and batch records. All of these documents are necessary to detail the manufacturing and testing processes so as to ensure that proper procedures are followed and results are documented. Indeed, these documents are subject to review by regulatory agencies, such as the U.S. Food and Drug Administration, and represent the mechanism by which such agencies can review the manufacturing and testing process details after the manufacture, testing, or handling of a drug product, for example, to assure patient safety.

However, paper and paper products are a significant contamination source due to shedding fibers, particulates and microorganisms (e.g., bacillus and mold). About 40% of paper products used in sterile environments are standard documents that can be pre-printed, packaged and sterilized by known means. However, the remainder of the documents introduced into sterile environments cannot be pre-printed, sterilized and packaged in a timely fashion. Their preparation requires information that is not readily available until days, or even hours, before the manufacturing or testing is to begin. In some instances, they must be prepared while manufacturing and/or testing is underway. Because of this, these documents are forced to be brought to sterilized areas without prior treatment for the reduction of shedding fibers, particulates and microorganisms. Thus, they represent a significant contamination source.

One solution in the industry is to pre-package products that must be introduced into a cleanroom environment. As disclosed in U.S. Pat. Nos. 6,123,900, 6,607,698 and 6,333,006, chemical containers are first pre-sterilized according to the methods set forth therein, and then the containers are enclosed within a first and second layer, and then placed into a carton having a liner. To unpackage, the container (with the two sealed layers and the liner) is removed from the carton on the loading dock. Once transported to a first sterile environment, the liner is removed and the container (now enclosed by two sealed layers) is placed on a shelf for future use. Once it is ready to be used, the second sealing layer is removed and the container (now enclosed by one sealed layer) is moved to a higher-grade sterile environment. In practice, that method requires that the outside of the liner and each sealing layer be sprayed with antiseptic and/or antibacterial sanitizers to remove any contaminants, such as bacteria and mold, before being transported to the next (more sterile) environment. Such an additional step causes vapors from the sanitizing agent to fill the atmosphere of the cleanroom, which introduces particles into the clean room and can be dangerous to the cleanroom operation as well as the workers. Additionally, according to this method, the product is removed from the last layer before it is transported to the final cleanroom where it is to be utilized.

To solve this problem, the invention provides for a method of packaging sterilized products by enclosing them in four successively sealed layers so as to ensure their sterility. Further, the invention provides a method of introducing packaged sterilized products, specifically paper products, into a sterile environment.

SUMMARY OF THE INVENTION

The invention provides a method of packaging a sterilized product, including the steps of providing a product, sterilizing the product, enclosing the sterilized product in a first layer and substantially hermetically sealing the first layer to form a first sealed enclosure, enclosing the first sealed enclosure in a second layer and substantially hermetically sealing the second layer to form a second sealed enclosure, enclosing the second sealed enclosure in a third layer and substantially hermetically sealing the third layer to form a third sealed enclosure, and enclosing the third sealed enclosure in a fourth layer and substantially hermetically sealing the fourth layer to form a packaged product.

The invention also provides a method of introducing a sterilized product into a sterilized environment, the sterilized product being sealed in successive first, second, third and fourth layers, including the steps of, removing the fourth layer to expose the third layer in an environment with a first predetermined sterility, removing the third layer to expose the second layer in an environment with a second predetermined sterility, the second predetermined sterility being higher than the first predetermined sterility, removing the second layer to expose the first layer in an environment with a third predetermined sterility, the third predetermined sterility being higher than the second predetermined sterility, and removing the first layer to expose the sterilized product in an environment with a fourth predetermined sterility, the fourth predetermined sterility being higher than the third predetermined sterility.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings; wherein.

DETAILED DESCRIPTION

Referring now to FIGS. 1-5, a method of packaging sterilized products so as to ensure their sterility, namely paper products, is provided. A method of introducing sterilized products, namely paper products, into a sterile environment is also provided. While the Figures provided herein are directed to paper products, any sterilized products may be used with the methods of the invention. The four-stage sealing methods described herein provide the benefit of ensuring protection against contamination inside the cleanroom, while maintaining the sterility of the packaged products. Once the products are removed from the successive sealing layers, no additional sanitizing step is needed since the last layer is removed within the cleanroom of the final destination where the product is used. This reduces cost because antibacterial and/or antiseptic sanitizers and sprays are not needed, and the cleanroom and its workers are protected from harmful vapors that are released when sanitizing agents are used on the products.

Generally, paper products (or similar printing media) are pre-sterilized and then packaged according to the methods of the invention. They are then shipped in cartons, such as cardboard containers with exterior plastic wrapping, to an end destination. The cardboard containers may be shipped by any known shipping method, such as by truck, rail or air transportation. The packaged products are then introduced into sterile environments according to the methods provided herein.

Figure 1:
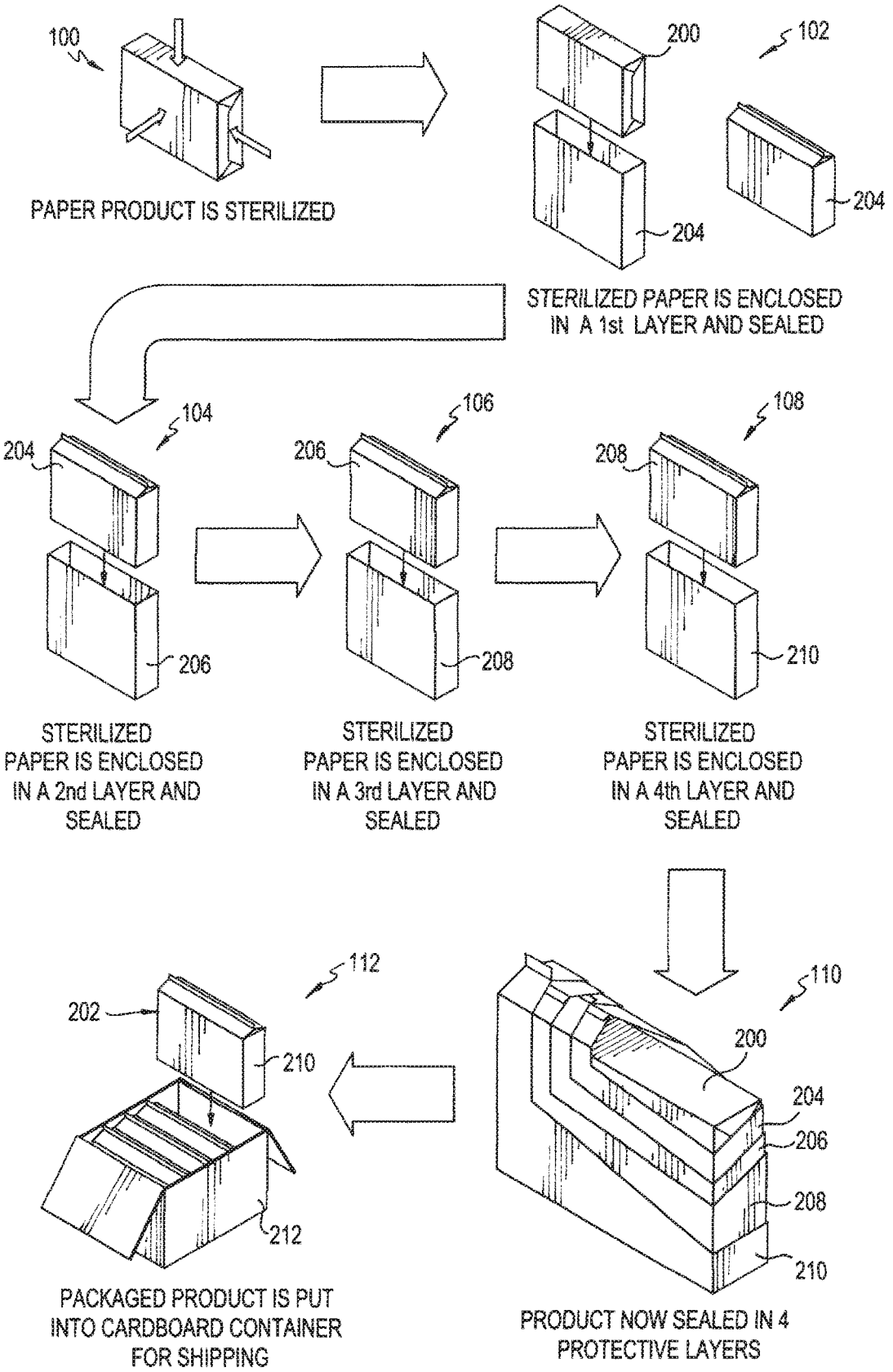
FIG. 1 is a block diagram showing the steps for the method of packaging a sterilized paper product.
Figure 2:
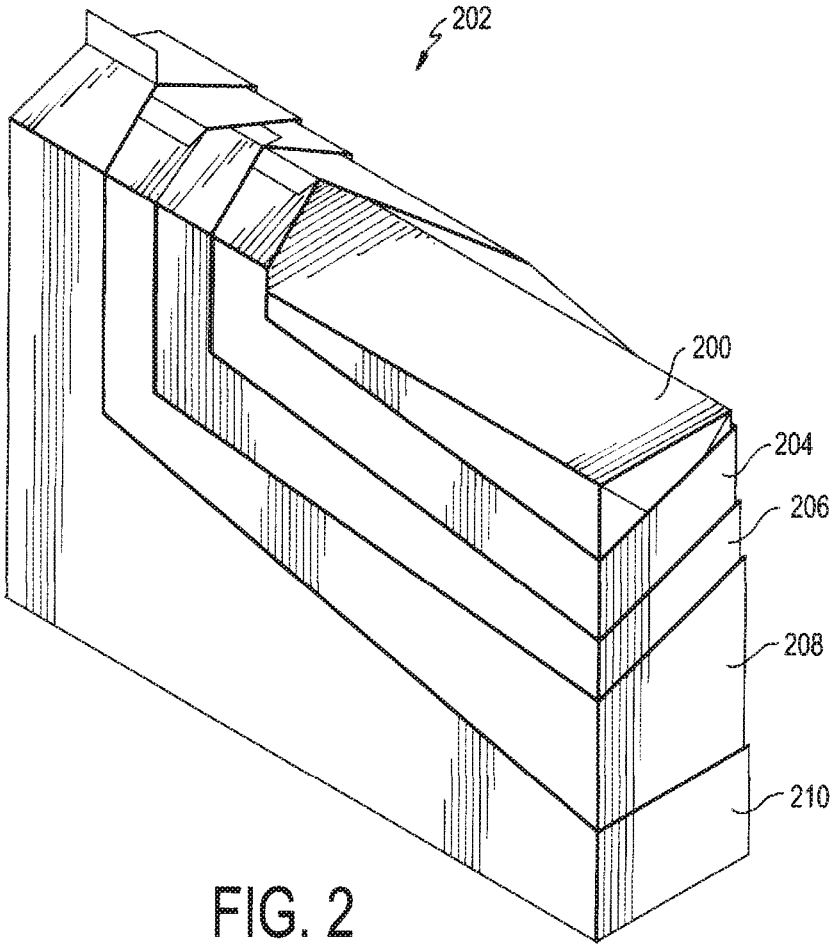
FIG. 2 is a perspective view of a packaged sterilized paper product according to an embodiment of the invention.
Figure 3A:
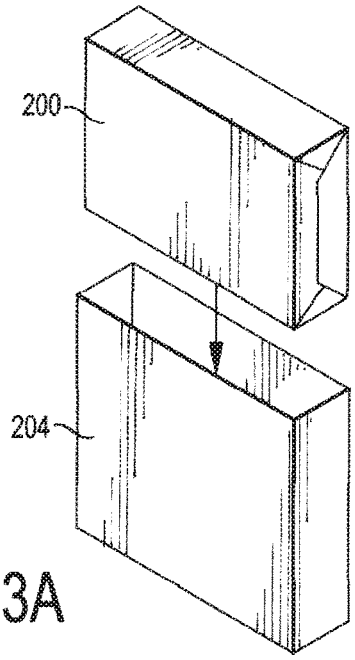
FIGS. 3A, 3B are exploded views of the first two layers of the packaged sterilized paper product depicted in FIG. 2.
Figure 3B:
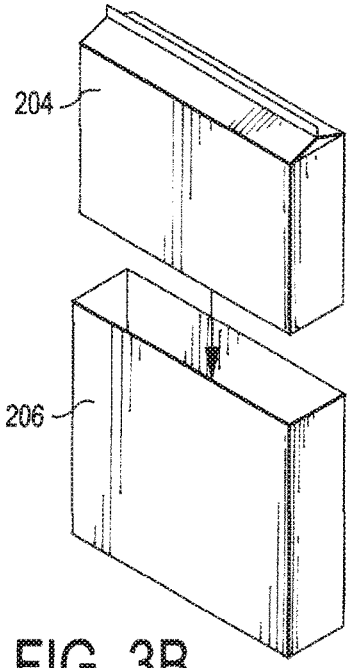

Referring to FIGS. 1-3, a paper product or printing medium 200 is first sterilized, according to step 100. According to one embodiment of the invention, common pulp-based paper may be used. According to a preferred embodiment, a non-shedding paper product, such as plastic, non-shedding Teslin® printing medium (manufactured by PPG Industries of Pittsburgh, Pa.) is used. The term "paper" as used herein includes both common pulp-based paper products as well as other types of printing media (e.g., Teslin® paper) known in the art. The paper may be provided on rolls at a predetermined length, or it may be provided as cut sheets prepared in reams (as shown in FIGS. 1-4). Any sterilization methods known to one skilled in the art may be used, including, but not limited to, steam, heat, chemical treatment, or gamma irradiation. In a preferred embodiment, gamma irradiation is used. The rolls or reams may then be packaged according to the methods of the invention.

Specifically, the sterilized paper 200 may undergo a quadruple "bagging" or "layering" process to form a final packaged product 202, as shown in FIG. 2. According to step 102, the sterilized paper 200 (which may be contained in a sealed paper enclosure, as shown) enclosed in a first layer 204 (FIG. 3A), which may then be sealed to form a substantially hermetically sealed first layer enclosure so as to keep out any contaminants. The first layer enclosure (containing the paper 200) is then enclosed in a second layer 206 (FIG. 3B) and the second layer 206 is then substantially hermetically sealed to form a second layer enclosure, according to step 104. This second layer enclosure (containing the first layer 204 and the sterilized paper 200) is then further enclosed in a third layer 208, which is also substantially hermetically sealed, to form a third layer enclosure according to step 106. Lastly, the third layer enclosure (containing the first and second layers 204, 206 and the sterilized paper 200) is enclosed in a fourth layer 210 and substantially hermetically sealed to form a fourth layer enclosure, according to step 108. Any sealing method known to one skilled in the art which forms a hermetic seal may be used for each of the sealing steps. According to a preferred embodiment, heat sealing is used. This process ultimately creates a final packaged product 202, whereby the sterilized paper product 200 is enclosed within four successive protective layers 204, 206, 208 and 210 each having a substantially hermetic seal, as shown in step 110. While not depicted in the Figures, the layering process may involve the use of more than four layers, for example, five or six layers, depending on the level of sterility required.

The four sealing layers 204, 206, 208 and 210 are preferably formed of a single-layer durable, waterproof plastic material, According to one embodiment, polyethylene is used, According to a preferred embodiment, the layers may be in the form of plastic bags.

Figure 4A:
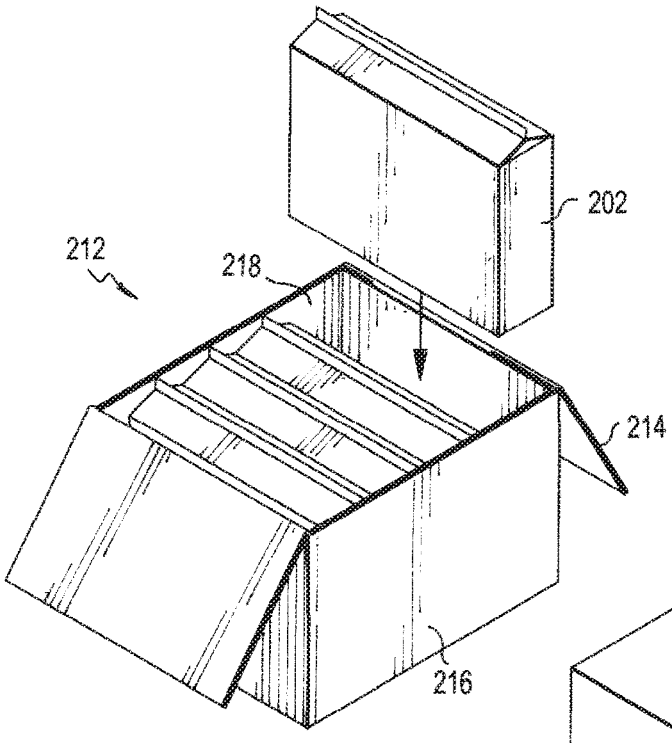
FIGS. 4A, 4B are exploded views of the packaged sterilized paper product depicted in FIG. 2 enclosed within a container for shipment.
Figure 4B:
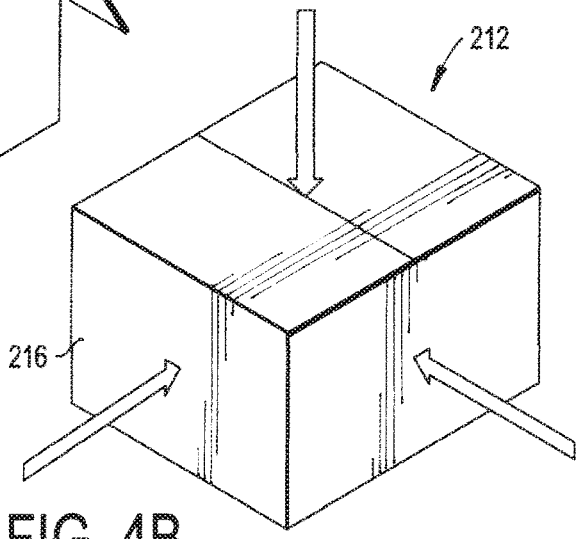

As shown in step 112 of FIG. 1, the final packaged product 202 may then be enclosed within a container 212 for shipping. According to one embodiment, the container 212 is a standard cardboard shipping container. The container 212 may have an internal liner 218 (see FIG. 4A) that lines the walls of the container 212 and acts as yet another sealing layer. The internal liner 218 may be formed of a plastic material (i.e., polyethylene bag) similar to sealing layers 204, 206, 208 and 210. Multiple packaged products 202 may be placed inside the internal liner 218 of the container 212. The internal liner 218 may then be closed via tying (e.g., twist tie) or some other known closure mechanism (e.g., rubber band) such that the packaged products 202 are enclosed therein. According to another embodiment, the internal liner 218 can be substantially hermetically sealed. Referring now to FIGS. 4A, 4B, the cardboard container 212 may then be closed in the standard manner, using flap closures 214. The cardboard container 212 may also have an exterior layer of plastic wrapping 216, or "shrink wrap," so as to protect the surface of the cardboard container 212 from outside contaminants. The cardboard container 212 may then be sterilized according to known methods in the art, such as, for example, gamma irradiation. Multiple cardboard containers 212 may then be placed on skids (not shown) for ease of transportation. The closed and sterilized cardboard containers 212 are then prepared for shipping and are transported for operational use downstream.

Figure 5:
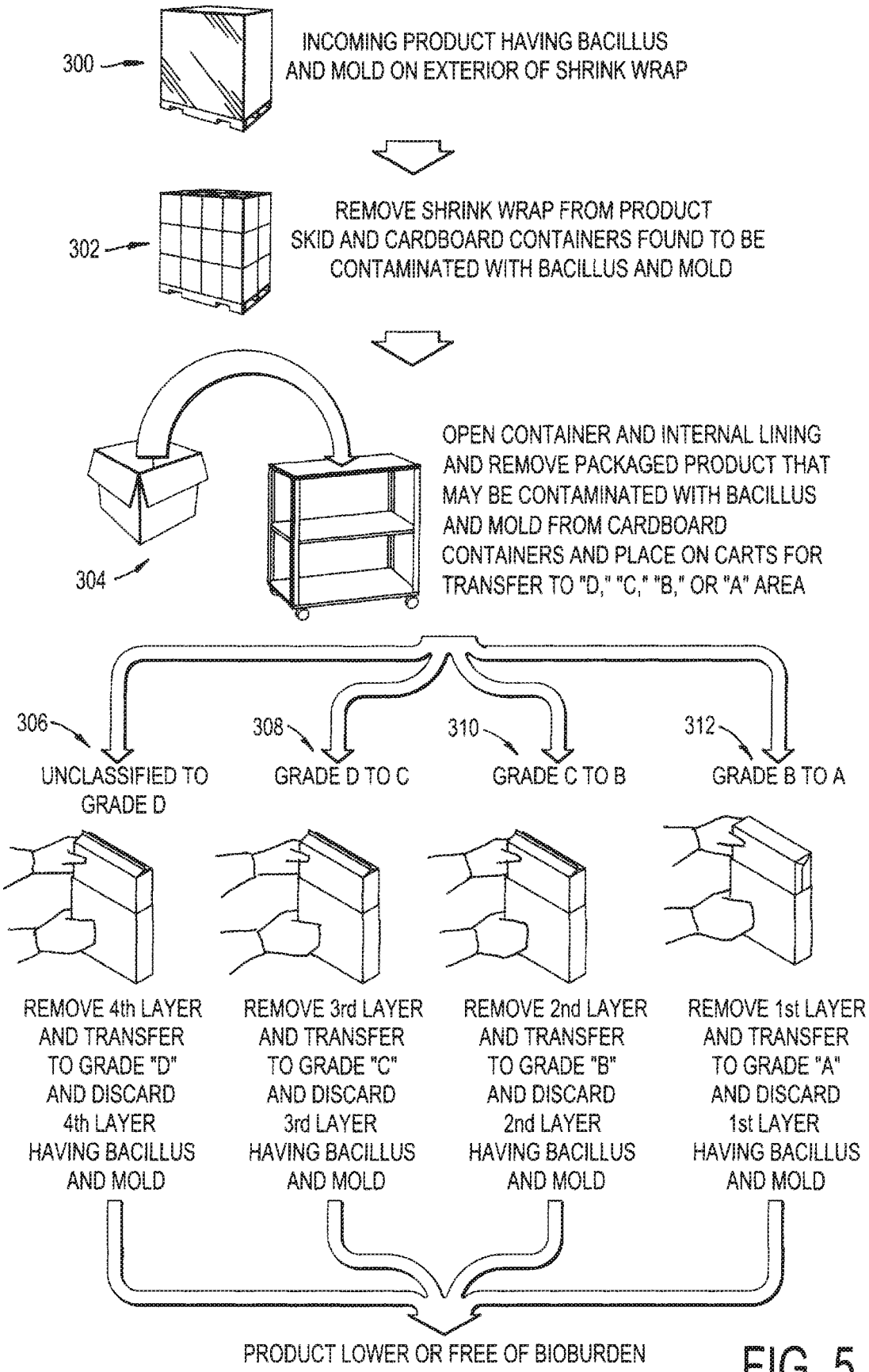
FIG. 5 is a block diagram showing the steps for the method of introducing paper products into a sterilized environment.

Referring now to FIG. 5, the cardboard container 212 arrives at the end destination and, inevitably, the plastic wrapping 216 is contaminated with many types of bacteria (e.g., bacillus), mold, and other microorganisms, as shown in step 300. Thus, the plastic wrapping or "shrink wrap" 216 is removed from the cardboard containers 212, as shown in step 302. The exterior of the cardboard container 212 and the transportation skids (not shown) are also contaminated with various microorganisms. Thus, as shown in step 304, the cardboard container 212 and internal layer 218 are opened, and the packaged product 200 located within the internal layer 218 is removed from the cardboard container 212 and placed on a vehicle, such as a cart, for transfer to the Grade D, C, B and A areas.

According to the invention, Grade A areas demand that all products entering the cleanroom be sterilized via steam, heat, chemical treatment, or gamma irradiation and packaged in multi-layer packaging configurations. "Grade B" areas are adjacent to Grade A areas and also demand sterilization and the use of multi-layer packaging configurations. Grade C and Grade D are consecutively adjacent to Grade B areas, such that any products bound for a Grade A area must pass through Grades C and D, which also demand low "bioburden," or contamination, to be present. The use of a multi-layer packaged product reduces the bioburden that may exist on the exterior of the packaging, while keeping the inner packaged produce free of particulates and microorganisms.

The classification of Grade A, B, C and D sterile environments are measured based upon the number and size of particles permitted per volume of air. Specifically, the ISO Cleanroom Standards correspond to the allowed number of particles having a minimum particle size per cubic meter. The ISO classification is set forth in Table I below.

TABLE 1

| ISO Cleanroom Standards | | | | | | |
|---|---|---|---|---|---|---|
| | Maximum number of particles per cubic meter | | | | | |
| Class | ≥0.1 μm | ≥0.2 μm | ≥0.3 μm | ≥0.5 μm | ≥1 μm | ≥5 μm |
| ISO 5 | 100,000 | 23,700 | 10,200 | 3,520 | 832 | 29 |
| ISO 6 | $1.0 \times 10^6$ | 237,000 | 102,000 | 35,200 | 8,320 | 293 |
| ISO 7 | $1.0 \times 10^7$ | $2.37 \times 10^6$ | 1,020,000 | 352,000 | 83,200 | 2,930 |
| ISO 8 | $1.0 \times 10^8$ | $2.37 \times 10^7$ | $1.02 \times 10^7$ | 3,520,000 | 832,000 | 29,300 |
| ISO 9 | $1.0 \times 10^9$ | $2.37 \times 10^8$ | $1.02 \times 10^8$ | 35,200,000 | 8,320,000 | 293,000 |

Normal ambient air is classified as ISO 9. According to the invention, Grade A areas correspondence to ISO 5, Grade B areas correspond to ISO 6, Grade C areas correspond to ISO 7, and Grade D areas correspondence to ISO 8. The methods provided below ensure that sterilized paper can be consecutively introduced from Grade D to Grade A, minimizing the level of contaminants between each Grade area until little to no contaminant is present when the product is introduced to the Grade A area.

Once the packaged product 202 arrives near the Grade D area, the fourth layer 210 (outermost layer) is removed and discarded by a first operator wearing protective gloves, as shown in step 306. As set forth above, the exterior of the fourth layer 210 inevitably has some amount of contamination. The packaged product 202 is then transferred to the Grade D area. Once the packaged product 202 arrives at the Grade D area, the third layer 208 is removed by a second operator (also wearing protective gloves) and discarded, as shown in step 308. This packaged product 202 is then transferred to the Grade C area. Once the packaged product 202 arrives at the Grade C area, the second layer 206 is removed by a third operator (also wearing protective gloves) and discarded, as shown in step 310. This packaged product 202 is then transferred to the Grade B area. Once the packaged product 202 arrives at the Grade B area, the first layer 204 (innermost layer) is removed by a fourth operator (also wearing protective gloves) and discarded, as shown in step 312. At this point, each of the layers 204, 206, 208 and 210 has been successively removed and the packaged product 202 should have little to no bioburden on its exterior surface. The paper rolls or reams 200 are then transferred to the Grade A area for their end use. The paper rolls or reams 200 may be inserted into the feed roller (for roll paper) or the paper tray (for ream paper) of a printing device within the Grade A area (not shown in FIG. 5), with the assurance that the paper 200 has been maintained in a sterilized state.

According to another embodiment, the first three steps of the method of FIG. 5 are performed, namely steps 300, 302 and 304. However, once the packaged product 202 is removed from the cardboard containers 212 and transported to the Grade D area, the fourth layer 210 (outermost layer) removed by a first operator and discarded in the Grade area (as opposed to outside of the Grade D area). Next, the third layer 208 is removed and discarded by a second operator in the Grade C area, and the second layer 206 is removed and discarded by a third operator in the Grade B area. The sterilized paper 200 contained within the first layer 204 (innermost layer) is then stored in a cabinet within the Grade A area until it is ready for use. When it is needed, the first layer 204 is removed and discarded by a fourth operator in the Grade A area, and the sterilized paper 200 is inserted into the feed rollers or paper tray as set forth above.

It is noted that the invention is described as having four sealing layers 204, 206, 208, 210, each of which successively encloses a single product. Each of the sealing layers 204, 206, 208, 210 can be a polyethylene bag that is sized to fit the single product and earlier layers, and is hermetically sealed such as by heat. However, it should be appreciated that other variations of the sealing layers 204, 206, 208, 210 can be provided within the spirit and scope of the invention. For instance, one or more of the outers sealing layers 208 and/or 210 can instead be a bag that receives two or more product and which is tied or otherwise closed using known mechanisms, such as, for example, a rubber band or twist tie. In one exemplary embodiment, the first layer 204 and second layer 206 are hermetically sealed, while the third layer 208 and fourth layer 210 are closed via the alternative methods discussed herein. According to yet another embodiment, the fourth layer 210 may be in the form of a bag liner 218 that lines the shipping container 212 used to transport the packaged product 202.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed:

1. A method of packaging a sterilized product, the method comprising:

sterilizing a product;

enclosing the sterilized product in a first layer, the first layer being configured to be removed in a Grade A environment to expose the sterilized product;

substantially hermetically sealing the first layer to form a first sealed enclosure;

enclosing the first sealed enclosure in a second layer, the second layer being configured to be removed in a Grade B environment to expose the first sealed enclosure;

substantially hermetically sealing the second layer to form a second sealed enclosure;

enclosing the second sealed enclosure in a third layer, the third layer being configured to be removed in a Grade C environment to expose the second sealed enclosure;

substantially hermetically sealing the third layer to form a third sealed enclosure;

enclosing the third sealed enclosure in a fourth layer, the fourth layer being configured to be removed in a Grade D environment to expose the third sealed enclosure; and substantially hermetically sealing the fourth layer to form a packaged product.

2. The method of claim 1, wherein sterilizing the product comprises sterilizing the product by gamma irradiation.

3. The method of claim 1, wherein the product is a printing medium.

4. The method of claim 1, wherein the first layer, the second layer, the third layer and the fourth layer are formed of a plastic material.

5. The method of claim 4, wherein the plastic material is a plastic bag.

6. The method of claim 1, wherein substantially hermetically sealing the first layer, the second layer, the third layer, and the fourth layer comprises heat sealing the first layer, the second layer, the third layer, and the fourth layer.

7. The method of claim 1, further comprising:

enclosing the packaged product in a container for shipping.

8. A method of packaging a sterilized product, the method comprising:

sterilizing a product;

enclosing the sterilized product in a first layer, the first layer being configured to be removed in a Grade B environment to expose the sterilized product;

substantially hermetically sealing the first layer to form a first sealed enclosure;

enclosing the first sealed enclosure in a second layer, the second layer being configured to be removed in a Grade C environment to expose the first sealed enclosure;

substantially hermetically sealing the second layer to form a second sealed enclosure;

enclosing the second sealed enclosure in a third layer, the third layer being configured to be removed in a Grade D environment to expose the second sealed enclosure;

substantially hermetically sealing the third layer to form a third sealed enclosure;

enclosing the third sealed enclosure in a fourth layer, the fourth layer being configured to be removed near the Grade D environment to expose the third sealed enclosure; and substantially hermetically sealing the fourth layer to form a packaged product.

9. The method of claim 8, wherein sterilizing the product comprises sterilizing the product by gamma irradiation.

10. The method of claim 8, wherein the product is a printing medium.

11. The method of claim 8, wherein the first layer, the second layer, the third layer and the fourth layer are formed of a plastic material.

12. The method of claim 11, wherein the plastic material is a plastic bag.

13. The method of claim 8, wherein substantially hermetically sealing the first layer, the second layer, the third layer, and the fourth layer comprises heat sealing the first layer, the second layer, the third layer, and the fourth layer.

14. The method of claim 8, further comprising:

enclosing the packaged product in a container for shipping.

15. A packaged sterilized product, comprising:

a sterilized product;

a first layer, substantially hermetically sealed, enclosing the sterilized product to form a first sealed enclosure, the first layer being configured to be removed in a Grade B environment to expose the sterilized product;

a second layer, substantially hermetically sealed, enclosing the first sealed enclosure to form a second sealed enclosure, the second layer being configured to be removed in a Grade C environment to expose the first sealed enclosure;

a third layer, substantially hermetically sealed, enclosing the second sealed enclosure to form a third sealed enclosure, the third layer being configured to be removed in a Grade D environment to expose the second sealed enclosure;

a fourth layer, substantially hermetically sealed, enclosing the third layer to form the packaged product, the fourth layer being configured to be removed near the Grade D environment to expose the third sealed enclosure.

16. The product of claim 15, wherein the product is sterilized by gamma irradiation.

17. The product of claim 15, wherein the product is a printing medium.

18. The product of claim 15, wherein the first layer, the second layer, the third layer and the fourth layer are formed of a plastic material.

19. The product of claim 18, wherein the plastic material is a plastic bag.

20. A packaged sterilized product, comprising:

a sterilized product;

a first layer, substantially hermetically sealed, enclosing the sterilized product to form a first sealed enclosure, the first layer being configured to be removed in a Grade A environment to expose the sterilized product;

a second layer, substantially hermetically sealed, enclosing the first sealed enclosure to form a second sealed enclosure, the second layer being configured to be removed in a Grade B environment to expose the first sealed enclosure;

a third layer, substantially hermetically sealed, enclosing the second sealed enclosure to form a third sealed enclosure, the third layer being configured to be removed in a Grade C environment to expose the second sealed enclosure;

a fourth layer, substantially hermetically sealed, enclosing the third layer to form the packaged product, the fourth layer being configured to be removed in a Grade D environment to expose the third sealed enclosure.

21. The product of claim 20, wherein the first layer, the second layer, the third layer, and the fourth layer are substantially hermetically sealed by heat sealing.

22. The product of claim 20, wherein the product is sterilized by gamma irradiation.

23. The product of claim 20, wherein the product is a printing medium.

24. The product of claim 20, wherein the first layer, the second layer, the third layer and the fourth layer are formed of a plastic material.

25. The product of claim 24, wherein the plastic material is a plastic bag.

26. The product of claim 20, wherein the first layer, the second layer, the third layer, and the fourth layer are substantially hermetically sealed by heat sealing.

* * * * *